United States Patent [19]

Uesugi et al.

[11] Patent Number: 4,929,326

[45] Date of Patent: May 29, 1990

[54] ELECTROLYTIC TREATMENT APPARATUS

[75] Inventors: Akio Uesugi; Ritsu Dobashi; Takeshi Ohishi, all of Shizuoka, Japan

[73] Assignee: Fuji Photo Film Co., Ltd., Kanagawa, Japan

[21] Appl. No.: 374,797

[22] Filed: Jul. 3, 1989

[30] Foreign Application Priority Data

Jul. 4, 1988 [JP] Japan ..... 63-164906

[51] Int. Cl.[5] ..... C25F 7/00

[52] U.S. Cl. ..... 204/206

[58] Field of Search ..... 204/206

[56] References Cited

FOREIGN PATENT DOCUMENTS 19191 9/1980 Japan .

19280 2/1981 Japan .

*Primary Examiner*—T. M. Tufariello

*Attorney, Agent, or Firm*—Sughrue, Mion, Zinn, Macpeack & Seas

[57] ABSTRACT

An electrolytic treatment apparatus for applying an electrochemical treatment by supplying an alternating current between a material being treated and a counter electrode in an electrolyte, wherein said electrolytic treatment being carried out by forming the counter electrode by a main counter electrode and an auxiliary counter electrode, connecting a circuit for the auxiliary counter electrode, in parallel, to a circuit connected to the main counter electrode, providing a diode or a mechanism of performing a diode-like action in the circuit for the auxiliary counter electrode for controlling an anode current in the main counter electrode, using an electrode containing magnetic iron oxide as the auxiliary counter electrode. The deterioration of the auxiliary counter electrode can be prevented without reducing the electrolytic treatment capacity, and cost for the equipment preservation can be greatly reduced.

6 Claims, 1 Drawing Sheet

ELECTROLYTIC TREATMENT APPARATUS

BACKGROUND OF THE INVENTION

This invention relates to an electrolytic treatment apparatus using an improved auxiliary counter electrode, and more particularly, to an electrolytic treatment apparatus suitable for graining a metal web by an alternating electric current, in particular, for graining an aluminum support for a printing plate suitable for offset printing.

As a support for a printing plate, in particular, a lithographic printing plate, an aluminum plate is used. For various requirements of users, various kinds of aluminum plates of from an almost pure aluminum plate to an aluminum plate containing manganese for increasing the strength are employed.

For using such an aluminum plate as a support for a printing plate, the aluminum plate is required to have a proper adhesive property with a light-sensitive material coated thereon and a water-holding property.

For the purpose, it is necessary to grain the surface of the aluminum plate such that the aluminum plate has the uniformly and precisely grained surface. Since the graining treatment gives remarkable influences on the printing performance of the printing plate, such as a staining performance of the printing plate, etc., the quality of the graining treatment is an important factor for producing printing plate in the case of actually performing printing.

As the graining process of an aluminum support for printing plate, there are a mechanical graining process, an electrochemical graining process, and a combination of these processes.

As the mechanical graining process, there are, for example, a ball graining process, a wire graining process, a brush graining process, and a liquid honing, etc. Also, as the electrochemical graining process, an alternating electrolytic etching process is generally employed, and in this case, an ordinary sine wave alternating current or a specific alternating current such as square wave alternating current, etc. is used. Also, as a pretreatment for the electrochemical graining treatment, an etching treatment by an aqueous sodium hydroxide solution may be employed.

In the alternating electrolytic etching process, there is a problem that a counter electrode composed of carbon or a metal is very liable to be deteriorated, differently from the phenomenon caused by a direct current. For example, when a counter electrode composed of carbon is used, the reaction of oxidation and reduction is repeatedly applied to the counter electrode whenever the polarity of the counter electrode is changed, to greatly deteriorate the binder for the counter electrode, whereby it is very difficult to use the electrode stably for a long period of time.

For solving the problem, an electrolytic treatment apparatus is disclosed in Japanese Patent Application Examined Publication No. 48596/86. In this apparatus, a circuit for an auxiliary counter electrode is connected, in parallel, to a circuit for a main counter electrode, and a diode or a mechanism of performing a diode-like action for controlling an anode electric current in the main counter electrode is provided in the circuit for the auxiliary counter electrode.

However, in the auxiliary counter electrode equipped with the diode-like mechanism, only an anode current passes through the auxiliary counter electrode, whereby the electrode is greatly deteriorated, the effect of forming the auxiliary counter electrode is reduced, and the deterioration of the auxiliary electrode becomes larger in cost than that of the main counter electrode.

Recently, a material such as platinum, iridium oxide, etc., has been practically used for anode current but the cost for exchanging such an electrode is very high.

As described above, the cost by the deterioration of the auxiliary counter electrodes in an electrolytic treatment apparatus is recently increased with the increase of mass production.

The following electrolytic treatment process, capable of preventing the occurrence of the deterioration of an auxiliary counter electrode without reducing the conventional electrolytic treatment faculty, is proposed in Japanese Patent Application No. 138479/88.

That is, the process is an electrolytic treatment process of applying an electrochemical treatment by supplying an alternating current between a material to be treated and a counter electrode in an electrolyte, wherein the electrolytic treatment being carried out by forming the counter electrode by a main counter electrode and an auxiliary counter electrode, connecting a circuit for the aforesaid auxiliary counter electrode, in parallel, to a circuit connected to the main counter electrode, providing a diode or a mechanism performing a diode-like action in the circuit for the auxiliary counter electrode for controlling an anode current in the main counter electrode, selecting the electrolytic condition in the auxiliary counter electrode t differ from that in the main counter electrode. For example, the concentration and temperature of the electrolyte at the side of the auxiliary counter electrode are selected to become lower than those at the side of the main counter electrode.

However, in the aforesaid process, an expensive material such as platinum, etc. is used as the auxiliary counter electrode. Thus, an inexpensive and more tough substituent for the expensive material has been desired.

SUMMARY OF THE INVENTION

An object of this invention is, therefore, to provide an electrolytic treatment apparatus using an inexpensive material having a high strength to the deterioration as the auxiliary counter electrode, other than means for preventing the deterioration of the counter electrode by employing the different electrolytic conditions as described above.

It has not been discovered that the aforesaid object can be attained by the apparatus of this invention as set further hereinafter.

That is, the present invention provides an electrolytic treatment apparatus for applying an electrochemical treatment to a material to be treated in an electrolyte, the apparatus comprising: a main counter electrode; an auxiliary counter electrode consisting of an electrode containing magnetic iron oxide; a first circuit connected to the main counter electrode including an alternating current source; a second circuit for the auxiliary counter electrode connected to the first circuit in parallel; and diode means for performing a diode-like action in the second circuit so as to control an anode current passing through the main counter electrode.

DETAILED DESCRIPTION OF THE PREFERRED EMBODIMENT

Figure 1:
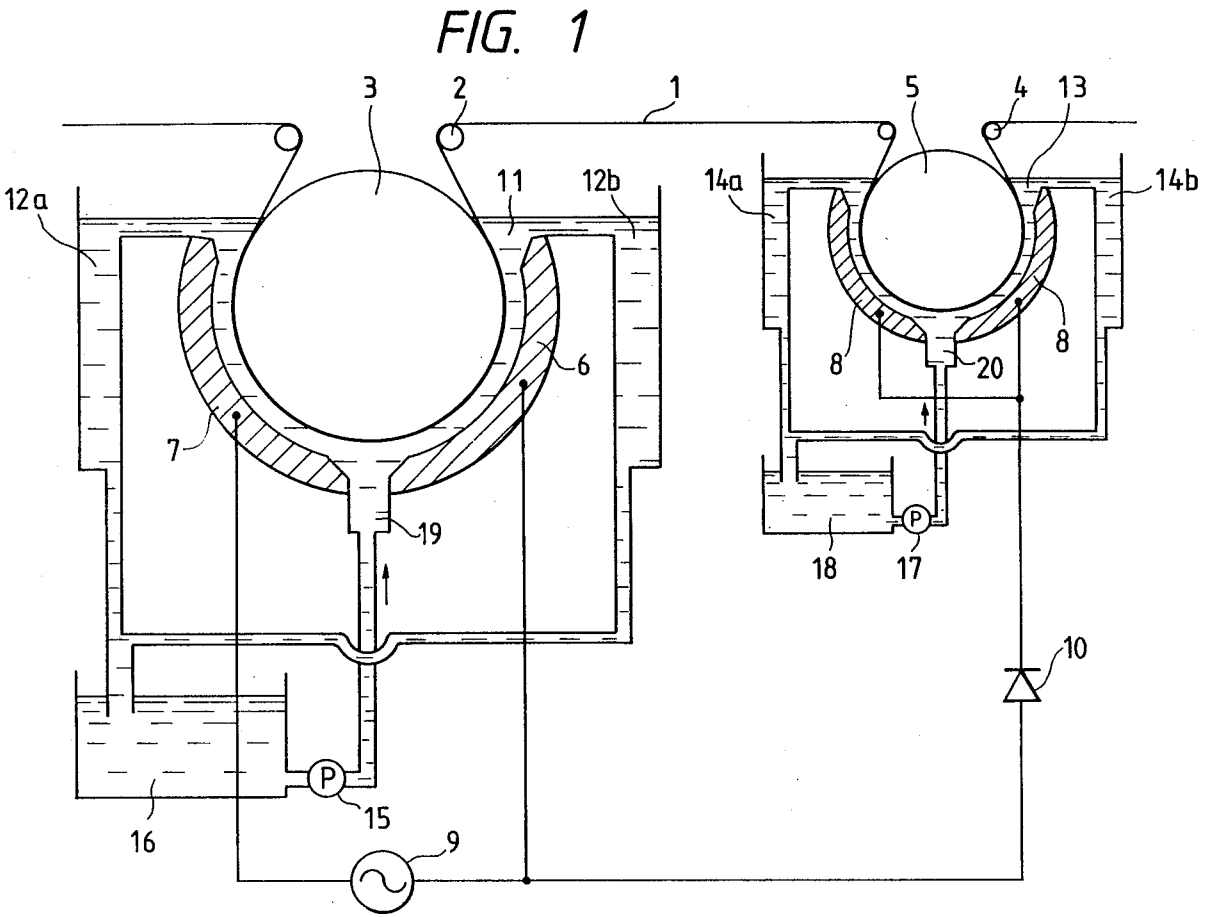
FIG. 1 is a schematic view showing an electrolytic treatment apparatus according to the present invention.

Then, an embodiment of the present invention will be described by referring to the accompanying drawing.

FIG. 1 shows an embodiment of the electrolytic treatment apparatus according to the present invention. A metal web 1 such as an aluminum web to be treated is passed through pass rollers 2 and 4, and is supported by radial drum rollers 3 and 5. The radial drum rollers 3 and 5 have a role of keeping a constant clearance between the metal web 1 and main counter electrodes 6 and 7, and also between the metal web 1 and auxiliary counter electrodes 8, 8, respectively. The clearance is usually set in the range of 3 to 50 mm. The ratio of the size of the main counter electrode to that of the auxiliary counter electrode depends upon the desired electrolytic etching condition. An alternating current of usually 0.1 Hz to 500 Hz is applied to the electrodes from an alternating current source 9. The frequency of the alternating current being applied differs according to the desired etching mode but if the frequency is lower than 15 Hz, the deterioration of the main counter electrodes 6 and 7 is large and the tendency is severe in the case of using carbon for the main counter electrodes. Various wave forms of the alternating current can be employed in this invention and the specific alternating wave forms described in Japanese Patent Application Examined Publications No. 19280/81 and No. 19191/80 may be employed.

A diode 10 is provided in the circuit connected to the auxiliary counter electrodes 8, 8 for controlling an electric current passing through the auxiliary counter electrodes 8, 8 so as to control an anode current passing through the main counter electrode 6. As the material for the auxiliary counter electrodes 8, 8, a sintered product made of at least 20% magnetic iron oxide and NiO is preferably used.

In the electrolytic treatment apparatus of this invention, the deterioration of the auxiliary electrode can be prevented by using an electrode containing magnetic iron oxide as the auxiliary counter electrode. Also, the deterioration thereof is further reduced by employing the optimum conditions for the concentration, temperature, flow rate of the electrolyte and the current density being applied.

Electrolytes 11 and 13 are filled, respectively, in the gap between the metal web 1 and the main counter electrodes 6 and 7, and the gap between the metal web 1 and the auxiliary counter electrodes 8, 8. Various sorts of electrolytes can be used, but in the case of graining a support for a lithographic printing plate, an aqueous solution mainly containing nitric acid or hydrochloric acid is preferably used. The electrolytes 11 and 13 are supplied through electrolyte supplying portions 19 and 20 from electrolyte tanks 16 and 18, respectively. Supply pump 15 is provided between the tank 16 and the portion 19, and supply pump 17 is provided between the tank 18 and the portion 20. The overflowing electrolytes 11 and 13 return to the electrolyte tanks 16 and 18 through portions 12*a*, 12*b*, 14*a* and 14*b*, respectively for reuse.

In the embodiment shown in the figure, the supply pump 15 and the electrolyte tank 16 are employed for the electrolytic operation by the main counter electrodes 6 and 7, and the supply pump 17 and the electrolyte tank 18 are employed for the electrolytic operation by the auxiliary counter electrodes 8, 8, so that the electrolytic condition for the main counter electrodes 6 and 7 and that for the auxiliary counter electrodes 8, 8 may be set up separately.

EXAMPLE 1

The electrolytic graining of an aluminum web was continuously carried out for 200 hours under the following conditions using the apparatus shown in FIG. 1.

Main Counter Electrode:
- Carbon

Auxiliary Counter Electrode:
- Sintered product composed of 40% magnetic iron oxide and 60% NiO The clearance between the web and the counter electrode:
- 10 mm Electrolytic Condition in Main Counter Electrode:
- Electrolyte: Aqueous nitric acid solution
- Concentration: 50 g/liter
- Temperature: 60° C.

Electrolytic Condition in Auxiliary Counter Electrode:
- Electrolyte: Aqueous nitric acid solution
- Concentration: 50 g/liter
- Temperature: 60° C.

Width of Aluminum Web: 1000 mm

Treatment Speed: 15 meters/min.

Frequency: 100 Hz

Under the aforesaid conditions, good graining was obtained and the deterioration of the auxiliary counter electrode was scarcely observed.

COMPARISON EXAMPLE 1

The same continuous operation as in Example 1, except that platinum was used as the auxiliary counter electrode, was followed using the apparatus shown in FIG. 1. In this case, good graining was obtained, but after 50 hours, the platinum auxiliary counter electrode was deteriorated and the electric current for the auxiliary counter electrode was stopped to stop the graining operation.

As is clear from the aforesaid example, according to the electrolytic treatment apparatus of this invention using an electrode containing magnetic iron oxide as the auxiliary counter electrode, the deterioration of the auxiliary counter electrode can be prevented without reducing the electrolytic treatment capacity, and cost for the equipment preservation can be greatly reduced.

What is claimed is:

1. An electrolytic treatment apparatus for applying an electrochemical treatment to a material to be treated in an electrolyte, the apparatus comprising:
- a main counter electrode;
- an auxiliary counter electrode consisting of an electrode containing magnetic iron oxide;
- a first circuit connected to the main counter electrode including an alternating current source;
- a second circuit for the auxiliary counter electrode connected to the first circuit in parallel; and
- diode means for performing a diode-like action in the second circuit so as to control an anode current passing through the main counter electrode.

2. The electrolytic treatment apparatus as claimed in claim 1, wherein the material to be treated is an aluminum web.

3. The electrolytic treatment apparatus as claimed in claim 1, wherein the electrolyte is an aqueous nitric acid solution or an aqueous hydrochloric acid solution.

4. The electrolytic treatment apparatus as claimed in claim 2, wherein the electrolyte is an aqueous nitric acid solution or an aqueous hydrochloric acid solution.

5. The electrolytic treatment apparatus as claimed in claim 1, wherein the auxiliary counter electrode is a sintered product containing magnetic iron oxide.

6. The electrolytic treatment apparatus as claimed in claim 5, wherein the sintered product is composed of at least 20% magnetic iron oxide and NiO.

* * * * *